US010526912B2

(12) United States Patent
Funk et al.

(10) Patent No.: US 10,526,912 B2
(45) Date of Patent: Jan. 7, 2020

(54) METHOD OF MEASURING TURBINE BLADE TIP EROSION

(71) Applicant: United Technologies Corporation, Farmington, CT (US)

(72) Inventors: Stanley J. Funk, Southington, CT (US); Edward F. Pietraszkiewicz, Southington, CT (US)

(73) Assignee: United Technologies Corporation, Farmington, CT (US)

( * ) Notice: Subject to any disclaimer, the term of this patent is extended or adjusted under 35 U.S.C. 154(b) by 911 days.

(21) Appl. No.: 15/134,429

(22) Filed: Apr. 21, 2016

(65) Prior Publication Data

US 2016/0230590 A1 Aug. 11, 2016

Related U.S. Application Data

(62) Division of application No. 13/208,983, filed on Aug. 12, 2011, now Pat. No. 9,322,280.

(51) Int. Cl.
*F01D 5/20* (2006.01)
*F01D 21/00* (2006.01)
(Continued)

(52) U.S. Cl.
CPC ..... *F01D 21/003* (2013.01); *F01D 5/141* (2013.01); *F01D 5/20* (2013.01); *F01D 25/24* (2013.01);
(Continued)

(58) Field of Classification Search
CPC ..... F01D 11/00; F01D 11/20; F01D 25/00; F01D 5/18
See application file for complete search history.

(56) References Cited

U.S. PATENT DOCUMENTS 3,936,217 A 2/1976 Travaglini et al.
4,884,820 A * 12/1989 Jackson ..... C21D 1/09 277/415
(Continued)

FOREIGN PATENT DOCUMENTS

EP 0907077 4/1999
EP 1258598 A2 11/2002
(Continued)

OTHER PUBLICATIONS

European Search Report for EP Application No. 12179735.1 dated Nov. 7, 2016.
(Continued)

*Primary Examiner* — Kayla McCaffrey
(74) *Attorney, Agent, or Firm* — Carlson, Gaskey & Olds, P.C.

(57) ABSTRACT

A method of designing a turbine blade includes the steps of forming at least two notches on a tip of a turbine blade, each of the at least two notches having a known dimension. The turbine blade has a pressure side and a suction side. The method further includes the step of operating a gas turbine engine including the turbine blade to expand a length of the turbine blade such that the tip of the turbine engages a casing. The method further includes the steps of viewing the tip of the turbine blade after the step of operating of the gas turbine engine, determining an appearance of the notches on the tip and determining a manufacturing length of the turbine blade based on the step of determining the appearance the notches.

14 Claims, 4 Drawing Sheets

(51) Int. Cl.
*F01D 5/14* (2006.01)
*F01D 25/24* (2006.01)

(52) U.S. Cl.
CPC ..... *F05D 2220/32* (2013.01); *F05D 2230/50* (2013.01); *F05D 2240/307* (2013.01); *F05D 2260/83* (2013.01); *Y10T 29/49336* (2015.01)

(56) References Cited

U.S. PATENT DOCUMENTS

| | | | | |
|---|---|---|---|---|
| 5,660,523 | A * | 8/1997 | Lee | F01D 5/20 415/115 |
| 6,148,518 | A | 11/2000 | Weiner et al. | |
| 6,179,556 | B1 | 1/2001 | Bunker | |
| 6,382,914 | B1 | 5/2002 | Tressler | |
| 6,478,537 | B2 | 11/2002 | Junkin | |
| 6,494,678 | B1 * | 12/2002 | Bunker | F01D 5/18 415/115 |
| 6,923,623 | B2 | 8/2005 | Cleveland et al. | |
| 7,455,495 | B2 | 11/2008 | Leogrande et al. | |
| 7,690,840 | B2 | 4/2010 | Zombo et al. | |
| 7,704,045 | B1 * | 4/2010 | Liang | F01D 5/20 416/228 |
| 7,972,115 | B2 * | 7/2011 | Potier | F01D 5/20 416/228 |
| 8,991,021 | B2 * | 3/2015 | Hebuterne | B23K 26/16 29/23.51 |
| 2002/0170176 | A1 | 11/2002 | Rigney et al. | |
| 2003/0020496 | A1 | 1/2003 | Eyraud et al. | |
| 2009/0142194 | A1 | 6/2009 | Draper et al. | |
| 2011/0176929 | A1 | 7/2011 | Ammann et al. | |
| 2011/0296687 | A1 | 12/2011 | Hebuterne et al. | |
| 2012/0207586 | A1 | 8/2012 | Chehab et al. | |

FOREIGN PATENT DOCUMENTS

| | | |
|---|---|---|
| EP | 2267275 A2 | 12/2010 |
| JP | 2004044423 | 2/2004 |
| JP | 2009-273717 A | 11/2009 |

OTHER PUBLICATIONS

Hearn, EJ, Mechanices of Materials 2, Third Edition, Nov. 25, 1997, p. 429.

* cited by examiner

METHOD OF MEASURING TURBINE BLADE TIP EROSION

CROSS REFERENCE TO RELATED APPLICATION

This application is a continuation of U.S. application Ser. No. 13/208,983 filed on Aug. 12, 2011.

BACKGROUND OF THE INVENTION

This application relates generally to a method of measuring tip erosion of a turbine blade during development and testing of the turbine blade.

During operation of a gas turbine engine, a turbine blade can tilt or expand due to creep (because of temperature and centrifugal forces). When a tip of the turbine blade rubs against a casing of the gas turbine engine, the tip can erode over time. It is important for the turbine blade to have a proper length to reduce wear at the tip while still providing a seal between the tip and the casing. During development of the gas turbine engine and the turbine blade, the gas turbine engine must be disassembled to access the hardware and the turbine blade to measure and determine any erosion, rub and tilt of the tip of the turbine blade, which is costly.

In one prior gas turbine engine, a seal serration part at a tip of a turbine blade includes a single notch. Over time and during normal operation of the gas turbine engine, the seal serration part rubs against a case to wear the seal serration part until the notch is eventually eliminated from the tip. When it is visually determined that the notch is eliminated, this indicates that the turbine blade is approaching fracture due to creep and must be replaced.

SUMMARY OF THE INVENTION

A method of designing a turbine blade includes the steps of forming at least two notches on a tip of a turbine blade, each of the at least two notches having a known dimension. The turbine blade has a pressure side and a suction side. The method further includes the step of operating a gas turbine engine including the turbine blade to expand a length of the turbine blade such that the tip of the turbine engages a casing. The method further includes the steps of viewing the tip of the turbine blade after the step of operating of the gas turbine engine, determining an appearance of the notches on the tip and determining a manufacturing length of the turbine blade based on the step of determining the appearance the notches.

A turbine blade includes a tip and at least two notches formed on the tip. Each of the least two notches have a known dimension. The turbine blade has a pressure side and a suction side.

A gas turbine engine assembly includes a casing including a hole and a turbine blade including a tip and at least two notches formed on the tip. Each of the at least two notches have a known dimension, and the turbine blade has a pressure side and a suction side. A borescope is inserted through the hole in the casing to view the notches on the tip.

These and other features of the present invention can be best understood from the following specification and drawings, the following of which is a brief description.

DETAILED DESCRIPTION OF THE PREFERRED EMBODIMENT

Figure 1:
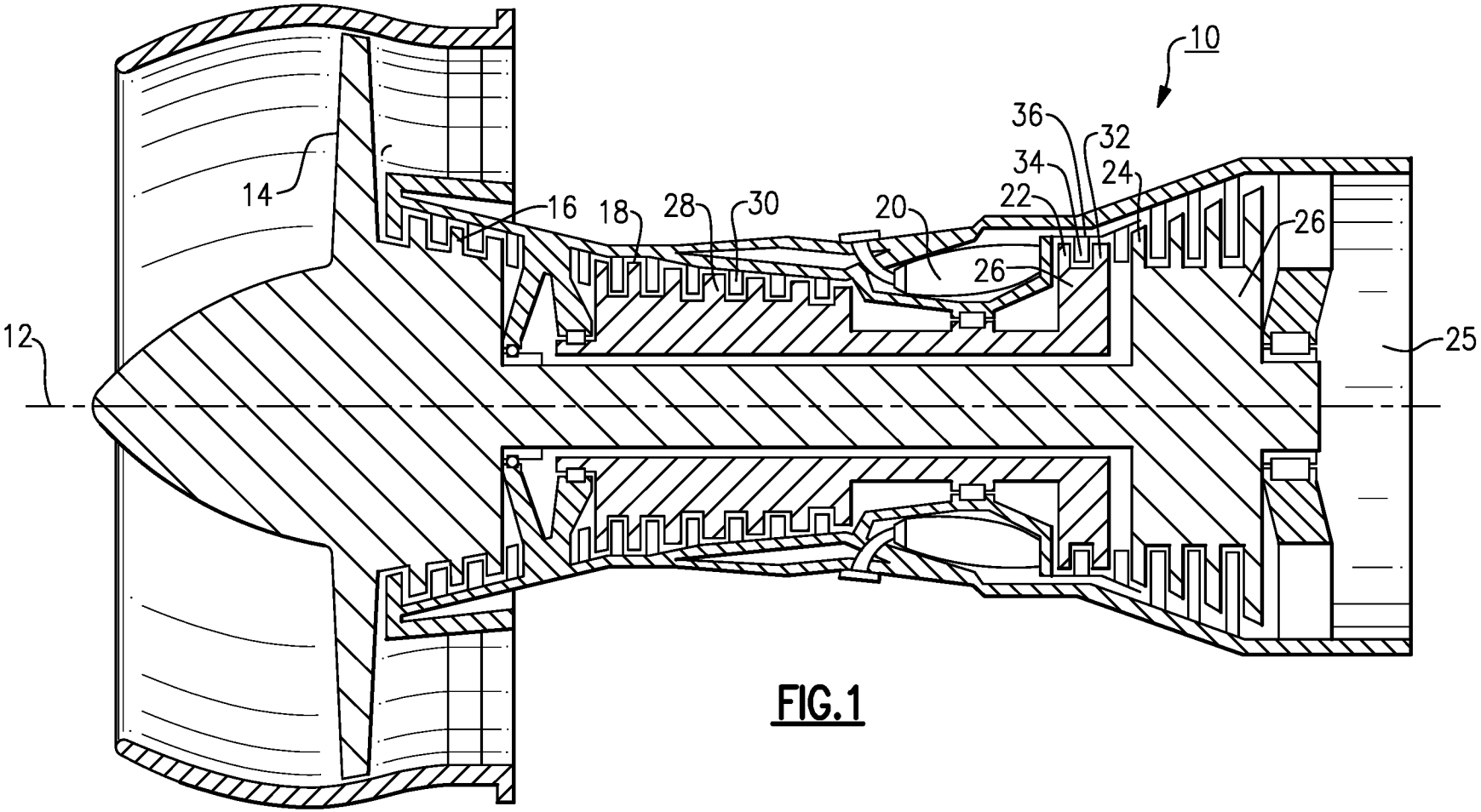
FIG. 1 illustrates a simplified cross-sectional view of a standard gas turbine engine.

As shown in FIG. 1, a gas turbine engine 10, such as a turbofan gas turbine engine, is circumferentially disposed about an engine centerline (or axial centerline axis 12). The gas turbine engine 10 includes a fan 14, a low pressure compressor 16, a high pressure compressor 18, a combustion section 20, a high pressure turbine 22 and a low pressure turbine 24. This application can extend to engines without a fan, and with more or fewer sections.

Air is pulled into the gas turbine engine 10 by the fan 14 and flows through a low pressure compressor 16 and a high pressure compressor 18. Fuel is mixed with the air, and combustion occurs within the combustion section 20. Exhaust from combustion flows through a high pressure turbine 22 and a low pressure turbine 24 prior to leaving the gas turbine engine 10 through an exhaust nozzle 25.

As is known, air is compressed in the compressors 16 and 18, mixed with fuel, burned in the combustion section 20, and expanded in the turbines 22 and 24. Rotors 26 rotate in response to the expansion, driving the compressors 16 and 18 and the fan 14. The compressors 16 and 18 include alternating rows of rotating compressor blades 28 and static airfoils or vanes 30. The turbines 22 and 24 include alternating rows of metal rotating airfoils or turbine blades 32 and static airfoils or vanes 34. It should be understood that this view is included simply to provide a basic understanding of the sections in a gas turbine engine 10 and not to limit the invention. This invention extends to all types of gas turbines for all types of applications, in addition to other types of turbines, such as vacuum pumps, air of gas compressors, booster pump applications, steam turbines, etc.

Figure 2:
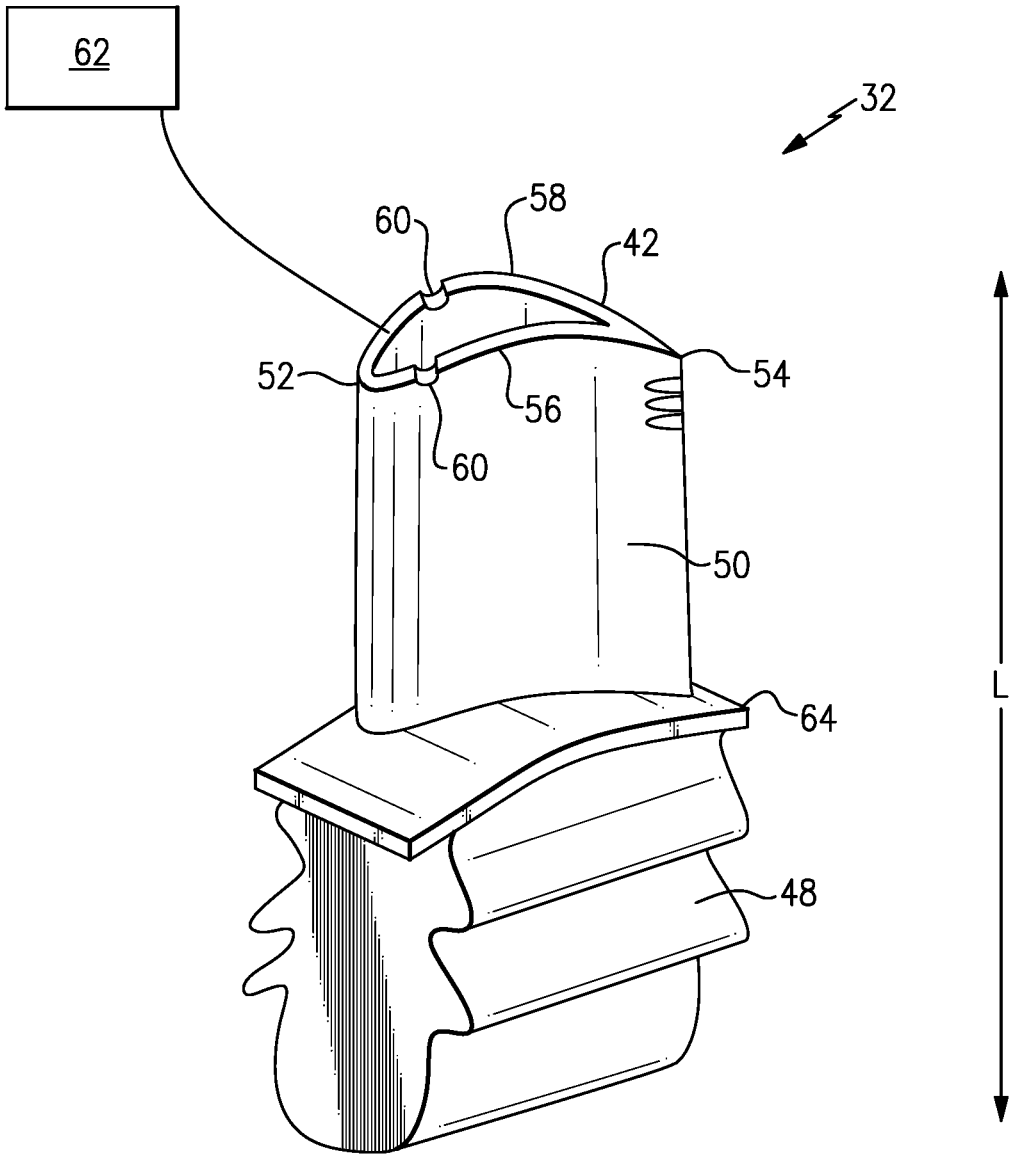
FIG. 2 illustrates a turbine blade with two notches formed on a tip.

FIG. 2 illustrates a turbine blade 32. The turbine blade 32 includes a root 48 received in a rotor disk (not shown), a platform 64, an airfoil 50, and a tip 42. The turbine blade 32 includes a leading edge 52 and a trailing edge 54. The turbine blade 32 also has a pressure side 56 and a suction side 58.

Prior to operation of the gas turbine engine 10, there is a gap between the tip 42 of the turbine blade 32 and the casing 36. During operation of the gas turbine engine 10, the turbine blades 32 expand due to heat and centrifugal forces such that the tip 42 rubs the casing 36, creating a seal. However, if the turbine blade 32 expands too much due to creep, the tip 42 can erode and wear. The turbine blade 32 can also tilt, causing a different amount of erosion and wear on either the pressure side 56 or the suction side 58 of the tip 42 of the turbine blade 32.

During the developmental and testing phase of the gas turbine engine 10 and the turbine blade 32, at least two notches 60 of known depth are formed on the tip 42 of the turbine blade 32. In one example, one of the at least two notches 60 is formed on the pressure side 56, and the other of the at least two notches is formed on the suction side 58 (as shown in FIG. 2). In another example, the least two notches 60 are both formed on the pressure side 56 or are both formed on the suction side 58. Alternately, a plurality of notches 60 can be formed on both the pressure side 56 and the suction side 58 (as shown in FIG. 3).

During development and testing of the gas turbine engine 10, the at least two notches 60 function as wear indicators that indicate how much wear occurs on the tip 42 of the turbine blade 32 during testing. Based on the data obtained from the wear of the at least two notches 60, the turbine blade 32 can be designed to have a specific length based on expected expansion and wear due to creep and tilt to ensure that there is optimal contact between the turbine blade 32 and the casing 36 during operation of the gas turbine engine 10 to create a seal while reducing wear.

In one example, the at least two notches 60 are machined. In one example, the at least two notches 60 are semi-circular in shape. The semi-circular shape minimizes stress concentration.

Figure 3:
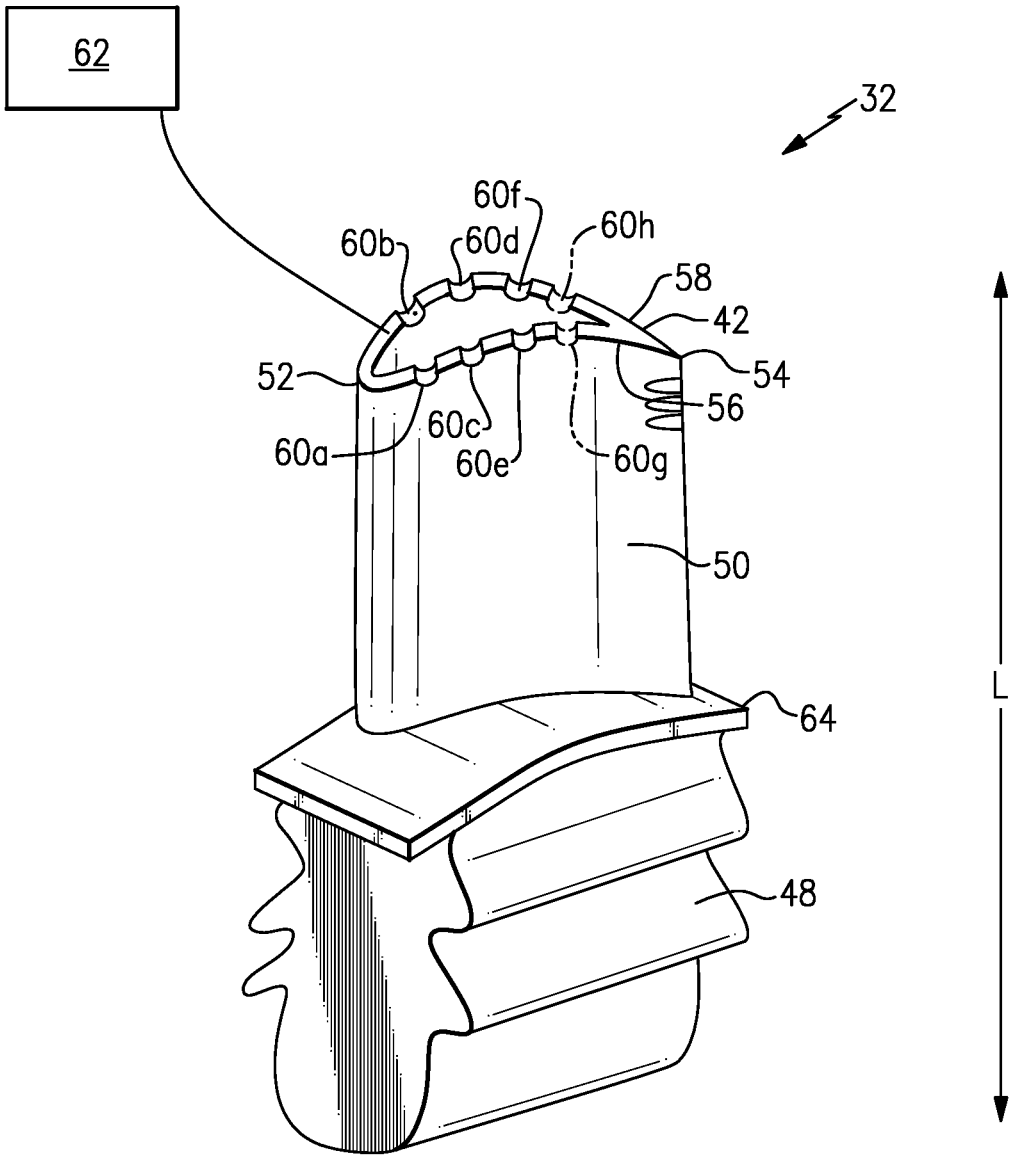
FIG. 3 illustrates a turbine blade with multiple notches formed on the tip.

In the example shown in FIG. 3, notches 60 having various radii are formed on the tip 42 of the turbine blade 32. The notches 60 are shown for illustrative purposes only and are not shown to scale. In one example, closest to the leading edge 52, a set of notches 60*a* and 60*b* is formed on the pressure side 56 and the suction side 58 of the turbine blade 32, respectively. Another set of notches 60*c* and 60*d* is formed closer to the trailing edge 54 on the pressure side 56 and the suction side 58 of the turbine blade 32, respectively. Another set of notches 60*e* and 60*f* is formed even closer to the trailing edge 54 than the set of notches 60*c* and 60*d* on the pressure side 56 and the suction side 58 of the turbine blade 32, respectively. The location and the radius of each of the notches 60*a*, 60*b*, 60*c*, 60*d*, 60*e* and 60*f* on the tip 42 of the turbine blade 32 are a function of design.

The turbine blade 32 in the developmental stage has a length L that is slightly longer than that the expected length of the final design of the turbine blade 32. In one example, the middle notches 60*c* and 60*d* each have a radius that is equal to the amount of wear that is expected when the gas turbine engine 10 is tested. That is, once the gas turbine engine 10 is tested, it is expected that the material above the notches 60*c* and 60*c* will be rubbed away such that the bottom of the notches 60*c* and 60*d* now define the tip 42. The length L of the turbine blade 32 and the radius of each the notches 60*c* and 60*d* are selected such this will be the expected result. However, as explained below, this might not be the case.

In a first example, the notches 60*a* and 60*b* have a radius of 0.005 mils (0.000127 mm), the notches 60*c* and 60*d* have a radius of 0.010 mils (0.000254 mm), and the notches 60*e* and 60*f* have a radius of 0.015 mils (0.000381 mm). However, the tip 42 of the turbine blade 32 can include any number of notches 60 each having any radius and the notches 60 can be placed in any location and configuration on the tip 42 of the turbine blade 32. The sequence and quantity of the notches 60 will be predetermined based on the needed understanding of the rub phenomenon that occurs during operating of the gas turbine engine 10 during development and testing.

In a second example, the turbine blade 32 can include a fourth set of notches 60*g* and 60*h* (shown in dashed lines in FIG. 3) that have a radius of 0.005 mils that is located closer to the trailing edge 54 than the notches 60*e* and 60*f*. In this example, from the leading edge 52 to the trailing edge 54, the notches 60*a* and 60*b* have a radius of 0.005 mils (0.000127 mm), the notches 60*c* and 60*d* have a radius of 0.015 mils (0.000381 mm), the notches 60*e* and 60*f* have a radius of 0.010 mils (0.000254 mm), and the notches 60*g* and 60*h* have a radius of 0.005 mils (0.000127 mm).

After the notches 60 are formed in the tip 42 of the turbine blade 32 and the gas turbine engine 10 is assembled, it is operated and tested. As the turbine blades 32 rotate and increase in temperature, they expand in length, and the tips 42 rub against the casing 36. After operation of the gas turbine engine 10 during the test ends, the turbine blades 32 cool and retract in length.

A borescope 62 (shown schematically) is then used to view the notches 60 and determine if any of the notches 60 have be eliminated due to erosion or rub of the tip 42 against the casing 36. The gas turbine engine 10 includes a pre-existing hole (not shown) that is filled with a plug (not shown). The plug is removed from the pre-existing hole, and the borescope 62 is inserted into a pre-existing hole to view the tip 42 of the turbine blade 32.

The borescope 62 is employed to view and determine how much of the tip 42 has worn away during testing of the gas turbine engine 10. As each notch 60 has a known radius, it can be determined how much of the tip 42 of the turbine blade 32 has worn away during operation by viewing the tip 42 and determining which notches 60 remain and which notches 60 have been eliminated due to wear or rub against the casing 36. From this information, the proper length of the turbine blade 32 for manufacture and actual use can be determined, and the turbine blades 32 that will be manufactured for use in actual operating gas turbine engines 10 will have this manufacturing length.

Figure 4:
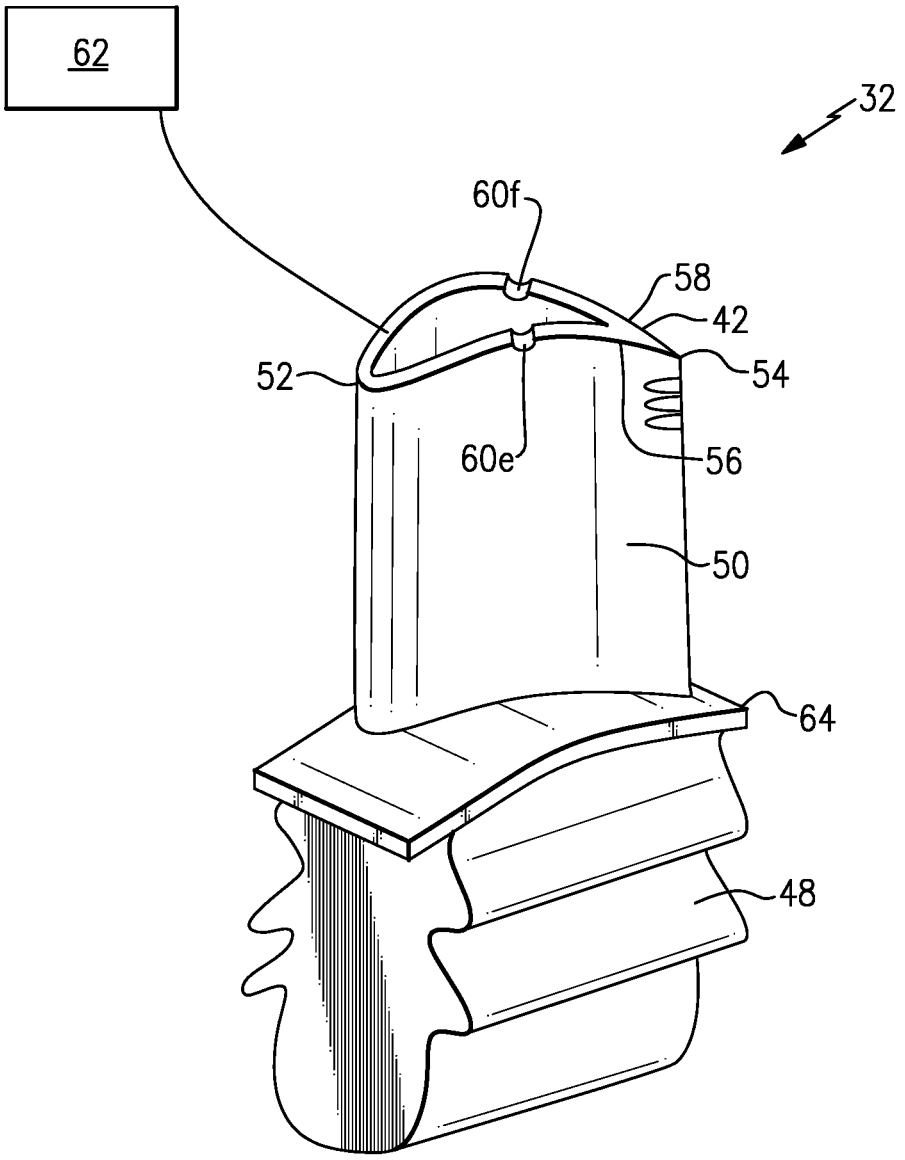
FIG. 4 illustrates a turbine blade after operation of the gas turbine engine.

For example, as stated above, the middle notches 60*c* and 60*d* each have a radius that is equal to the amount of wear that is expected when the gas turbine engine 10 is tested. Returning to the first example, as shown in FIG. 4, if the middle notches 60*c* and 60*d* have been completely eliminated during testing due to rubbing of the tip 42 with the casing 36 (which also means the notches 60*a* and 60*b* with the smaller radii have been eliminated by rubbing), but the notches 60*e* and 60*f* (which have a larger radii) remain, this indicates that 0.010 mils (0.000254 mm) of material has eroded from the airfoil 50 during the test. Based on this knowledge, it can be determined that the turbine blades 32 are to be manufactured with a manufacturing length that is 0.010 mils (0.000254 mm) less than the length L of the turbine blade 32 prior to the test.

In another example, if only the notches 60*a* and 60*b* are eliminated during the test due to rubbing of the tip 42 with the casing 36, this indicates that 0.005 mils (0.000127 mm) of material has eroded from the airfoil 50 during the test. Based on this knowledge, it can be determined that the turbine blades 32 are to be manufactured with a manufacturing length that is 0.005 mils (0.000127 mm) less than the length L of the turbine blade 32 prior to the test.

By viewing the notches 60 each having a known radius remaining on the tip 42 of the turbine blade 32 after the test cycle with a borescope 62, it can be determined how much of the airfoil 50 has eroded because of rub and wear with the casing 36. The turbine blade 32 can then be manufactured with the determined manufacturing length so that when the turbine blade 32 expands due to creep during use, the tip 42 of the turbine blade 32 contacts the casing 36 to create a proper seal while reducing wear.

Alternately, the amount of wear of the notches 60*a*, 60*c* and 60*e* on the pressure side 56 is compared to the amount of wear of the notches 60*b*, 60*d* and 60*f* on the suction side 58 of the turbine blade 32 after testing by viewing with the borescope 62. If it is viewed based on the visual appearance of the notches 60 that there is more wear on one side 56 or 58 of the turbine blade 32 than the other side 56 or 58 of the turbine blade 32 due to the elimination of more notches 60 on one side 56 or 58 of the turbine blade 32 than the other side 56 or 58 of the turbine blade, this could indicate that tilt is occurring. The turbine blade 32 can then be designed and manufactured to take this into account.

By collecting data on erosion and wear of the tip 42 of the turbine blade 32 during testing and determining the amount of erosion and wear to the tip 42 due to creep and/or tilt prior to manufacturing the turbine blade 32 and assembling the gas turbine engine 10 for actual use, the turbine blade 32 can be designed to have a length that prevents erosion and wear during actual use while still providing a seal. By viewing the condition and existence of the notches 60 after testing the gas turbine engine 10 and visually evaluating their condition, presence or absence by the borescope 62 based on the known radii, any creep and tilt can be detected and be taken into consideration when designing and determining the actual length of the turbine blades 32.

By using a borescope 62 to view the condition of the tip 42 of the turbine blade 32, it is not necessary to disassemble the gas turbine engine 10 during development and engine testing, which provides a cost saving. Evaluation and disposition of several potential distress modes (i.e., creep, erosion, and tilt) is possible without tearing down the gas turbine engine 10 and needing measuring devices. Therefore, the turbine blade 32 can be made with the proper specifications, size and length prior to manufacturing.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A turbine blade comprising:

a tip; and at least two notches formed on the tip, wherein each of the at least two notches has a known radius, and the turbine blade has a pressure side and a suction side, each of the at least two notches have a different radius, one of the at least two notches is located on the pressure side of the turbine blade, and another of the at least two notches is located on the suction side of the turbine blade.

2. The turbine blade as recited in claim 1, wherein the at least two notches have a semi-circular shape.

3. The turbine blade as recited in claim 1, wherein the at least two notches comprise three notches, and two notches are formed on at least one of the pressure side of the turbine blade and the suction side of the turbine blade.

4. The turbine blade as recited in claim 1, wherein the tip engages a casing during testing.

5. The turbine blade as recited in claim 1, wherein the tip and the at least two notches have an initial appearance before testing the turbine blade and an appearance after testing the turbine blade that is different from the initial appearance.

6. The turbine blade as recited in claim 1, wherein the at least two notches comprises a first set of three notches and a second set of three notches.

7. The turbine blade as recited in claim 6, wherein the first set of three notches and the second set of three notches each comprise a first notch having a radius of 0.005 mils, a second notch having a radius of 0.010 mils, and a third notch having a radius of 0.015 mils, wherein the first notch is located closest to a leading edge of the turbine blade, the second notch is located between the first notch and the third notch, and the third notch is located closest to a trailing edge of the turbine blade.

8. A gas turbine engine comprising:

a turbine blade including a tip and at least two notches formed on the tip, wherein each of the at least two notches has a known radius, the turbine blade having a pressure side and a suction side, at least one of the at least two notches is located on one of the pressure side and the suction side, and each of the at least two notches have a different radius, wherein the tip and the at least two notches have an initial appearance before testing the turbine blade and an appearance after testing the turbine blade that is different from the initial appearance caused by removal of at least a portion of the tip and the at least two notches during testing; and a casing including a hole adapted to receive a borescope to view the tip of the turbine blade.

9. A gas turbine engine as recited in claim 8, wherein the at least two notches have a semi-circular shape.

10. The gas turbine engine as recited in claim 8, wherein one of the at least two notches is located on the pressure side of the turbine blade, and another of the at least two notches is located on the suction side of the turbine blade.

11. The gas turbine engine as recited in claim 9, wherein both of the at least two notches are formed on at least one of the pressure side of the turbine blade and the suction side of the turbine blade.

12. The gas turbine engine as recited in claim 8, wherein the tip engages the casing during testing.

13. The gas turbine engine as recited in claim 8, wherein the at least two notches comprises a first set of three notches and a second set of three notches.

14. The gas turbine engine as recited in claim 13, wherein the first set of three notches and the second set of three notches each comprise a first notch having a radius of 0.005 mils, a second notch having a radius of 0.010 mils, and a third notch having a radius of 0.015 mils, wherein the first notch is located closest to a leading edge of the turbine blade, the second notch is located between the first notch and the third notch, and the third notch is located closest to a trailing edge of the turbine blade.

* * * * *